US009902922B2

(12) United States Patent
Reinhardt et al.

(10) Patent No.: US 9,902,922 B2
(45) Date of Patent: Feb. 27, 2018

(54) BLEACHING-AGENT CO-GRANULES, METHOD FOR PRODUCING SAID BLEACHING-AGENT CO-GRANULES, AND USE OF SAID BLEACHING-AGENT CO-GRANULES

(71) Applicant: WeylChem Wiesbaden GmbH, Wiesbaden (DE)

(72) Inventors: Gerd Reinhardt, Kelkheim (DE); Michael Best, Bad Soden (DE); Miriam Ladwig, Dietzenbach (DE); Andreas Schottstedt, Hofheim (DE); Mathias Groeschen, Waldbrunn-Hintermeilingen (DE); Sven Gebhard, Liederbach (DE)

(73) Assignee: WEYLCHEM WIESBADEN GMBH, Wiesbaden (DE)

( * ) Notice: Subject to any disclaimer, the term of this patent is extended or adjusted under 35 U.S.C. 154(b) by 103 days.

(21) Appl. No.: 14/898,164

(22) PCT Filed: May 9, 2014

(86) PCT No.: PCT/EP2014/001265

§ 371 (c)(1),
(2) Date: Dec. 14, 2015

(87) PCT Pub. No.: WO2014/198369

PCT Pub. Date: Dec. 18, 2014

(65) Prior Publication Data

US 2016/0152929 A1 Jun. 2, 2016

(30) Foreign Application Priority Data

Jun. 15, 2013 (DE) ..... 10 2013 010 549

(51) Int. Cl.

| | |
|---|---|
| ***C11D 3/37*** | (2006.01) |
| ***C11D 3/395*** | (2006.01) |
| ***C11D 3/39*** | (2006.01) |
| ***C11D 3/32*** | (2006.01) |
| ***C11D 3/30*** | (2006.01) |
| ***C11D 17/00*** | (2006.01) |

(52) U.S. Cl.

CPC ..... *C11D 3/3955* (2013.01); *C11D 3/30* (2013.01); *C11D 3/32* (2013.01); *C11D 3/3757* (2013.01); *C11D 3/3761* (2013.01); *C11D 3/391* (2013.01); *C11D 3/392* (2013.01); *C11D 3/3912* (2013.01); *C11D 3/3915* (2013.01); *C11D 3/3917* (2013.01); *C11D 3/3922* (2013.01); *C11D 3/3925* (2013.01); *C11D 3/3935* (2013.01); *C11D 17/0073* (2013.01); *C11D 17/0091* (2013.01)

(58) Field of Classification Search

CPC ..... C11D 3/30; C11D 3/32; C11D 3/3757; C11D 3/391; C11D 3/3912; C11D 3/3915; C11D 3/3917; C11D 3/392; C11D 3/3922; C11D 3/3925; C11D 3/3927; C11D 3/3935; C11D 17/0039; C11D 17/06

USPC ..... 510/311, 312, 313, 349, 376, 476

See application file for complete search history.

(56) References Cited

U.S. PATENT DOCUMENTS

| | | | | |
|---|---|---|---|---|
| 6,878,680 | B2 * | 4/2005 | Kitko | C11D 3/2075 510/311 |
| 8,486,881 | B2 * | 7/2013 | Borchers | C11D 3/3932 510/224 |
| 8,883,704 | B2 | 11/2014 | Borchers et al. | |
| 9,102,903 | B2 * | 8/2015 | Reinhardt | C11D 3/3932 |
| 2012/0094889 | A1 * | 4/2012 | Borchers | C11D 3/2075 510/220 |

FOREIGN PATENT DOCUMENTS

| | | | |
|---|---|---|---|
| DE | 102006056248 | A1 | 5/2008 |
| WO | 2003093405 | A2 | 11/2003 |
| WO | 2010115581 | A1 | 10/2010 |

OTHER PUBLICATIONS

International Search Report dated Jul. 18, 2014.
International Preliminary Report on Patentability dated Dec. 17, 2015 (English translation).

* cited by examiner

*Primary Examiner* — Gregory R Delcotto
(74) *Attorney, Agent, or Firm* — Michael W. Ferrell

(57) ABSTRACT

The invention relates to a bleaching-agent co-granule containing a bleach activator, a metal-containing bleach catalyst comprising at least one ligand from the group consisting of di- or trimethyltriazacyclononane and derivatives of these, and a homo- or copolymeric polycarboxylate or its salts or partial neutralizates having a pH in the range from 3 to 9. The bleaching-agent co-granule is obtained in an anhydrous granulating process, preferably by compaction at a temperature below 100° C. The invention also relates to the method of using the bleaching-agent co-granule in dishwasher detergents and to a detergent comprising said bleaching-agent co-granule.

20 Claims, No Drawings

BLEACHING-AGENT CO-GRANULES, METHOD FOR PRODUCING SAID BLEACHING-AGENT CO-GRANULES, AND USE OF SAID BLEACHING-AGENT CO-GRANULES

CLAIM FOR PRIORITY

This application is a national phase application of PCT/EP2014/001265 FILED May 9, 2014 which was based on application DE 10 2013 010 549.8 FILED Jun. 15, 2013. The priorities of PCT/EP2014/001264 and DE 10 2013 010 150.6 are hereby claimed and their disclosures incorporated herein by reference.

TECHNICAL FIELD

The present invention relates to bleaching-agent co-granules, to a process for producing them and also to their use in washing and cleaning compositions, in particular in dishwasher detergents.

BACKGROUND

Dishwasher detergents incorporate persalts such as perborates and percarbonates for spotless results. To activate these bleaching agents and in order to achieve a satisfactory bleaching effect at wash cycle temperatures of 60° C. or below, dishwasher detergents generally further contain bleach activators or bleach catalysts, and it is particularly the bleach catalysts which have proven to be particularly effective.

Bleach catalysts are preferably incorporated into dishwasher detergents in the form of ready-made granules. This is done not only to increase their storage stability, but also in order to increase homogeneous incorporation of minuscule catalyst quantities into the formulations, in particular in tablet applications.

Bleach catalysts based on various manganese-containing transition metal complexes are described in EP 0 458 397, EP 0 458 398 and EP 0 530 870 for example. Processes for producing bleach catalyst granules are disclosed in EP 0 544 440, WO 95/06710 and WO 2008/069935. The processes described therein typically utilize large volumes of inert materials as carriers and also binders, which may optionally be used in melt form, this procedure including cooling and/or drying steps necessitating the use of additional apparatus such as fluidized bed systems.

Yet the germ-killing effect of bleach catalysts is mostly minor. The performance of bleaching agents in dishwasher detergents is accordingly higher when in the form of a combination of a bleach catalyst with a bleach activator. In this case, the peroxycarboxylic acid formed out of the activator works effectively to augment the bleaching effect of the catalyst. The peroxycarboxylic acid also makes a significant contribution to the germ kill on the ware, improves the odor of the wash liquor and prevents the development of a biofilm in the dishwasher. The combination of bleach catalysts and bleach activators is accordingly sensible to enhance bleach performance and to ensure hygiene when bleaching agents are incorporated into washing and cleaning compositions. Washing and cleaning compositions formulated to include not only the bleach activator such as tetraacetylethylenediamine (TAED), sodium nonanoyloxybenzenesulfonate (NOBS) or decanoyl-oxybenzoic acid (DOBA) but also one or more bleach catalysts are known according to the prior art. EP 0 710 714, for instance, describes a bleach composition comprising TAED, a manganese catalyst and crystalline sheet-silicate. These components are incorporated into the laundry detergent formulation as separate particles, but not in the form of a unitary co-granule.

The use of activators and catalysts as separate particles or granules, however, has disadvantages which may have adverse repercussions for bleaching performance. The persalt and/or the hydrogen peroxide released therefrom react with the activator and the catalyst in concurrent reactions. If the catalyst granule is quicker to dissolve than the activator granule, then the persalt will already have been consumed before it is able to react with the activator. The reverse case is analogous. Co-granules as between activators and catalysts are further advantageous to ensure homogeneous distribution of the two components throughout the detergent and to save space in the formulation. A saving is also achieved in the costs of production, since only one co-granule has to be produced instead of two different granules.

WO 03/093405 describes co-granules consisting of a bleach catalyst, a bleach activator and, optionally, a coating. As shown in Example 1, a manganese(II) complex, a TAED powder and a tallow fatty alcohol ethoxylate (Genapol® T500, Clariant) are mixed in a Lödige mixer at 40 to 50° C. and then pressed by an extruder into noodle-shaped granules. Preferred bleach catalysts for producing such co-granules are metal complexes with macrocyclic cross-bridged ligands as described in WO 01/64826 and WO 98/39098. These are notable for particularly good chemical stability.

WO 2010/115581 describes co-granules containing a) one or more bleach activators, b) one or more bleach catalysts and c) at least 5 wt % of one or more organic acids. Fatty acids, alcohol ethoxylates or polymers are referred to as possible binders. Judging by the examples, the preferred binder is Genapol® T500.

A multiplicity of the bleach catalysts referred to in WO 2010/115581, in particular manganese salts, are accordingly convertible into storage-stable odorless co-granules suitable for use in washing and cleaning compositions.

Surprisingly, however, co-granules consisting of TAED, $[Mn^{IV}_2(\mu\text{-}O)_3(\text{Me-TACN})\ 2](PF_6)_2.H_2O$ and Genapol® T500 and obtained as taught in WO 03/093405 or WO 2010/11558 are found to have a distinct amine odor after a certain storage period. They are accordingly unsuitable for any commercial use in household products. It is believed that at least a small proportion of the manganese complex decomposes during co-granule production and/or storage, releasing the ligand trimethyltriazacyclononane (TACN), which has a pronounced amine-type odor.

SUMMARY OF INVENTION

It is an object of the present invention to provide co-granules which, in addition to a bleach activator, also contain a bleach catalyst comprising at least one ligand from the group consisting of di- or trimethyltriazacyclononane or a derivative thereof that are storage stable and, in particular, odorless for a prolonged period.

We have found that, surprisingly, this object is achieved and that storage-stable odorless co-granule particles containing a bleach activator and a bleach catalyst comprising at least one ligand from the group consisting of di- or trimethyltriazacyclononane and a derivative thereof are obtainable when the bleach activator is compounded with the bleach catalyst at temperatures <100° C. in an anhydrous granulating process, wherein a binder is used in the form of a room temperature solid homo- or copolymeric polycarboxylate, in particular a poly(meth)acrylic acid or its salts or partial neutralizates having a pH in the range from 3 to 9.

The present invention accordingly provides bleaching-agent co-granules containing a bleach activator, a metal-containing bleach catalyst comprising at least one ligand from the group consisting of di- or trimethyltriazacyclononane and derivatives of these, and a homo- or copolymeric polycarboxylate or its salts or partial neutralizates having a pH in the range from 3 to 9, their characterizing feature being that they are obtained in an anhydrous granulating process, preferably by compaction, and the temperature in the anhydrous granulating process is maintained below 100° C.

The bleaching-agent co-granule of the present invention is further characterized in that it does not contain any alcohol ethoxylates or derivatives of ethylene oxide or of propylene oxide.

Co-granules of the present invention are particularly advantageous with regard to their odor, their performance and their storage stability—and hence preferable—when they, in each case relative to the overall weight of the co-granule, contain a) 50 to 90 wt % of one or more bleach activators;
b) 0.01 to 10 wt % of one or more metal-containing bleach catalysts having at least one ligand from the group consisting of di- or trimethyltriazacyclononane and derivatives thereof; and
c) 5 to 40 wt % of one or more binders based on polyacrylic acids or their salts with a pH in the range from 3 to 9.

It is particularly preferable for the bleaching-agent co-granules of the present invention to contain, relative to the overall weight of the co-granule, a) 65 to 85 wt % of one or more bleach activators;
b) 0.05 to 6 wt % of one or more metal-containing bleach catalysts having at least one ligand from the group consisting of di- or trimethyltriazacyclononane and derivatives thereof; and
c) 10 to 30 wt % of one or more binders based on polyacrylic acids or their salts with a pH in the range from 3 to 9.

DETAILED DESCRIPTION

Bleach Activators (Component a)

By way of bleach activators, the co-granules of the present invention may contain polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular N-nonanoyloxy- or n-lauroyloxybenzenesulfonate (NOBS or LOBS respectively), acylated phenolcarboxylic acids, in particular nonanoyloxy- or decanoyloxybenzoic acid (NOBA or DOBA respectively), carboxylic anhydrides, in particular phthalic anhydride, acylated polyhydric alcohols, in particular triacetin, ethylene glycol diacetate and 2,5-diacetoxy-2,5-dihydrofuran and also acetylated sorbitol and mannitol and/or their mixtures (SORMAN), acylated sugar derivatives, in particular pentaacetylglucose (PAG), pentaacetylfructose, tetra-acetylxylose and octaacetyllactose and also acetylated, optionally N-alkylated glucamine and gluconolactone, and/or N-acylated lactams, for example N-benzoylcaprolactam. Hydrophilically substituted acylacetals and acyllactams are likewise used with preference.

Nitrile derivatives such as n-methylmorpholinio-acetonitrile methylsulfate (MMA) or cyanomorpholine (MOR) may also be used as bleach activators. Similarly, combinations of conventional bleach activators are useful. TAED, NOBS and DOBA are particularly preferred bleach activators.

Bleach Catalysts (Component b)

Bleach catalysts used in the context of the present invention are preferably bleach-boosting transition metal salts and/or complexes of manganese, of iron, of cobalt, of ruthenium, of molybdenum, of titanium or of vanadium.

Preference is further given to complexes of iron in the oxidation states II or III and of manganese in the oxidation state II, III, IV or IV, which preferably comprise one or more macrocyclic ligands having the donor functions N, NR, PR, O and/or S, in each of which R is a hydrocarbyl moiety of up to 5 carbon atoms. Preference is given to using ligands having nitrogen donor functions.

The co-granules of the present invention preferably utilize transition metal complexes comprising mono- or dinuclear complexes of general formulae A or B Formula A

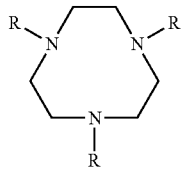

Formula B

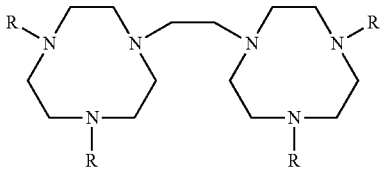

where R=H, $CH_3$, $C_2H_5$, or $C_3H_7$.

Preferred ligands are 1,4,7-trimethyl-1,4,7-triazacyclononane (Me-TACN), 1,4,7-triazacyclononane (TACN) or bridged ligands such as 1,2-bis-(4,7-dimethyl-1,4,7-triazacyclonono-1-yl)ethane (Me4-DTNE), as described for example in EP 0 458 397, EP 0 458 398, EP 0 549 272, WO 96/06154, WO 96/06157 or WO 2006/125517.

Useful manganese complexes include, for example, the polynuclear complexes $[Mn^{III}_2(\mu\text{-}O)_1(\mu\text{-}OAc)_2(TACN)_2](PF_6)_2$, $[Mn^{IV}_2(\mu\text{-}O)_3(Me\text{-}TACN)_2](PF_6)_2$, $[Mn^{IV}_2(\mu\text{-}O)_3(Me\text{-}TACN)_2](SO_4)$, $[Mn^{IV}_2(\mu\text{-}O)_3(Me\text{-}TACN)_2](OAc)_2$, $[Mn^{IV}_2(\mu\text{-}O)_3(Me\text{-}TACN)_2](Cl)_2$, $[Mn^{IV}Mn^{III}_2(\mu\text{-}O)_2(OAc)(Me4\text{-}DTE)](Cl)_2$, $[Mn^{IV}Mn^{III}_2(\mu\text{-}O)_2(OAc)(Me4\text{-}DTE)](PF_6)_2$ or the mononuclear complexes $[Mn^{IV}(Me\text{-}TACN)(OCH_3)_3]PF_6$ (obtained as described in EP 544 519), $[Mn^{IV}(Me\text{-}TACN)(OC_2H_5)_3]PF_6$ and $[Mn^{IV}(Me\text{-}TACN)(acac)OH]PF_6$ or $[Mn^{III}(Me\text{-}TACN)(acac)OC_2H_5)]PF_6$, the latter prepared as described by K. Wieghardt et al., Zeitschrift für Naturforschung 43b, 1184-1194 (1988). Since some of these complexes crystallize in hydrated form (with water of crystallization), these forms are employed with preference, one example thereof being $[Mn^{IV}_2(\mu\text{-}O)_3\ (Me\text{-}TACN)_2](PF_6)_2{*}H_2O$.

Particularly preferred metal-containing bleach catalysts are selected from the group: $[Mn^{III}_2(\mu\text{-}O)_1(\mu\text{-}OAc)_2(Me\text{-}TACN)_2](PF_6)_2$, $[Mn^{IV}_2(\mu\text{-}O)_3(Me\text{-}TACN)_2](PF_6)_2{*}H_2O$, $[Mn^{IV}_2(\mu\text{-}O)_2(\mu\text{-}OAc)(Me4\text{-}DTE)]Cl_2$, $[Mn^{IV}(Me\text{-}TACN)(OCH_3)_3]PF_6$ or $[Mn^{IV}(Me\text{-}TACN)(acac)OCH_3]PF_6$.

Binders (Component c)

The co-granules of the present invention further contain a binder to ensure co-granule coherence.

The binder is characterized in that it comprises homo- or copolymeric polycarboxylates, in particular polymers or copolymers of acrylic acid and/or of methacrylic acid (referred to herein as "poly(meth)acrylic acid"), preferably in the form of their salts or in partially neutralized form. A 1% solution in water of the binder used should have a pH of 3 to 9, but especially between 3.5 and 8.5. Homo- or copolymeric polycarboxylates, preferably with maleic acid, are concerned here in particular. Polyacrylic acid or polymethacrylic acid for example are preferred, especially those having an average molar mass of 500 to 70 000 g/mol.

Preference thereamong is given to poly(meth)acrylates, which preferably have a molar mass of 2000 to 20 000 g/mol. Of this group, it is especially the short-chain poly (meth)acrylates with molar masses of 2000 to 10 000 g/mol and preferably of 3000 to 5000 g/mol which are preferable by virtue of their superior solubility.

Preference thereamong is further given to copolymeric polycarboxylates, in particular those of acrylic acid with methacrylic acid and of acrylic acid or methacrylic acid with maleic acid. Copolymers of acrylic or methacrylic acid with maleic acid where the acrylic or methacrylic acid content is from 50 to 90 wt % and the maleic acid content is from 50 to 10 wt % have been found to be particularly useful. Their average molar mass relative to free acids is preferably in the range from 2000 to 70 000 g/mol, more preferably in the range from 20 000 to 50 000 g/mol and most preferably in the range from 30 000 to 40 000 g/mol. Preferred polymers are Sokalan® CP45 and CP5 from BASF in substantially anhydrous form, preferably in powder or granule form.

To improve their solubility in water, the polymers may also contain structural units derived from allylsulfonic acids, for example allyloxybenzenesulfonic acid and methallylsulfonic acid. Particular preference is also given to biodegradable polymers formed from more than two different monomer units, for example those containing structural units derived from salts of acrylic and/or methacrylic acid and maleic acid and also from vinyl alcohol and/or vinyl alcohol derivatives and sugar derivatives, or structural units derived from salts of acrylic and/or methacrylic acid and 2-alkylallylsulfonic acid and from sugar derivatives.

Preferred copolymers further include those containing structural units derived from acrolein and acrylic acid/acrylic acid salts or methacrylic acid/methacrylic acid salts, and/or acrolein and vinyl acetate.

Anionic polymers employed with preference as binders further include sulfonated polymers, in particular copolymers formed from unsaturated carboxylic acids, sulfonated monomers with or without further ionogenic or nonionogenic monomers.

Optional Adjunct Materials:

The co-granules of the present invention may contain adjunct materials known to boost the efficacy of the TACN-containing bleach catalyst. Examples thereof include particularly oxalic acid, ascorbic acid and glyoxalic esters and their acetals or hemiacetals.

In the simplest embodiment of the invention, the co-granule of the invention does not have a coating in the form of a protective layer.

In one preferred embodiment of the invention, the co-granule of the invention does additionally have a coating in the form of a protective layer to further improve the storage stability and to allow the co-granule to be provided with color, if so desired. The proportion of the overall granule which is accounted for by the protective or coating layer should then be not less than 5 wt %, more preferably not less than 7 wt % and most preferably not less than 15 wt %. There is an upper limit to the proportion of the overall granule which is accounted for by the protective or coating layer and preferably it is 30 wt %.

Preference for use as coating layer is given to solid organic compounds having film-forming properties, e.g., waxes, polyvinyl alcohols or the substances already used as binders (c). Optionally, the coating layer may additionally contain small amounts of water-soluble or water-insoluble organic dyes.

Producing the Bleaching-Agent Co-Granules of the Present Invention

The bleaching-agent co-granules of the present invention are in principle obtainable using various anhydrous methods of granulation.

A preferred method of production comprises the pulverulent actives first being mixed and the mixture then being compacted, thereafter ground with or without subsequent sieving into individual particle size fractions. The compacting is preferably effected on so-called roll compactors (e.g., from Hosokawa-Bepex, Alexanderwerk, Koppern). The roll profile can be varied to produce either pellets or briquettes or a compacted sheet. While it typically merely remains to separate the piece compacts from the fines, the sheet compact has to be comminuted in a mill down to the desired size of particle. Typically, the types of mill used are preferably of the gentle type, for example sieve and hammer mills (e.g., from Hosokawa-Alpine, Hosokawa-Bepex) or roll stands (e.g., from Bauermeister, Bühler).

The granule material thus obtained is sieved to remove the undersize fraction and, if present, the oversize fraction. The oversize fraction is recycled to the mill, whereas the undersize fraction is recycled into the compaction process. The granules can be classified using commonplace sieving machines such as, for example, tumble or vibration sieves (e.g., from Allgaier, Sweco, Vibra).

The bleaching-agent co-granules of the present invention are primarily characterized by their chemical composition. It has nonetheless been found that the bleaching effect of these bleaching-agent co-granules can also be influenced by influencing physical parameters such as, for example, the corpuscle size, the fines fraction and also the bleach catalyst content of selected sieved fractions.

Preferred bleaching-agent co-granules of the present invention are accordingly characterized in that the co-granule material has an average corpuscle size between 0.1 and 1.6 mm, preferably between 0.2 and 1.2 mm and more preferably between 0.3 and 1.0 mm, all measured by sieve analysis.

The bleaching-agent co-granules of the present invention are suitable for use in any washing or cleaning compositions, although their use in dishwasher detergents has been found to be particularly advantageous.

It is believed that the organic acid in the bleaching-agent co-granules of the present invention performs a protective function and prevents the reaction of alkaline constituents of the washing composition with the non-alkali-resistant and hydrolysis-sensitive bleach activators and bleach catalysts of the bleaching-agent co-granules according to the present invention.

The present invention accordingly further provides the method of using a bleaching-agent co-granule of the present invention in the manufacture of washing and cleaning compositions and preferably in the manufacture of dishwasher detergents.

The present invention further also provides washing and cleaning compositions, preferably dishwasher detergents, comprising a bleaching-agent co-granule of the present invention.

Preferred washing and cleaning compositions according to the present invention, in particular the dishwasher detergents, incorporate the bleaching-agent co-granules of the present invention in amounts between 0.1 and 10 wt %, preferably in amounts between 0.2 and 8 wt % and more preferably in amounts between 0.5 and 6 wt %.

The washing and cleaning compositions of the present invention, in particular the dishwasher detergents, which may be in the form of granules or in the form of pulverulent or tablet-shaped solids, but also in liquid or pasty form, may incorporate in principle any known and customary (in such compositions) ingredients in addition to the co-granule of the present invention.

The washing and cleaning compositions of the present invention, in particular the dishwasher detergents, may more particularly incorporate builder substances, peroxygen compounds, enzymes, alkali carriers, surfactants, pH regulators, organic solvents and further, auxiliary materials, such as glass corrosion inhibitors, silver corrosion inhibitors and foam regulators. The bleaching-agent co-granules of the present invention are useful in both phosphate-containing and phosphate-free formulations.

Particularly preferred washing and cleaning compositions, in particular dishwasher detergents, incorporate i) 15 to 65 wt %, preferably 20 to 60 wt % of a water-soluble builder component,
ii) 5 to 25 wt %, preferably 8 to wt %, of a peroxygen compound,
iii) 0.5 to 6 wt % of a bleaching-agent co-granule of the present invention, and
iv) 0 to 50 wt % of further, adjunct components such as enzymes, alkali carriers, surfactants, pH regulators, organic solvents or further, auxiliary materials, such as glass corrosion inhibitors, silver corrosion inhibitors and foam regulators, all relative to the overall weight of the washing and cleaning composition.

A composition of this type is specifically of low alkalinity, i.e., its 1 weight percent solution has a pH in the range from 8 to 11.5 and preferably from 9 to 11.

Water-Soluble Builder Component and/or Substances

Water-soluble builder components for use in the washing and cleaning compositions of the present invention, in particular the dishwasher detergents, include in principle any builders typically used in such compositions, for example alkali metal phosphates, which may be in the form of their alkaline, neutral or acidic sodium or potassium salts. Examples thereof are trisodium phosphate, tetrasodium diphosphate, disodium dihydrogendiphosphate, pentasodium triphosphate, so-called sodium hexametaphosphate and also the corresponding potassium salts and/or mixtures of sodium and potassium salts. Their amounts may range from 15 up to about 65 wt %, preferably from 20 to 60 wt %, relative to the overall composition. Possible water-soluble builder components further include not only polyphosphonates and phosphonatoalkyl carboxylates but also, for example, organic polycarboxylates polymers of natural or synthetic origin which act as co-builders in hard-water regions in particular. Possibilities include, for example, polyacrylic acids and copolymers formed from maleic anhydride and acrylic acid, and also the sodium salts of these polymeric acids. Commercially available products include, for example, Sokalan® CP 5, CP 10 and PA 30 from BASF. Useful co-builder polymers of natural origin include, for example, oxidized starch and polyamino acids such as polyglutamic acid or polyaspartic acid. Possible water-soluble builder components further include naturally occurring hydroxy carboxylic acids such as, for example, monohydroxy-succinic acid, dihydroxysuccinic acid, alpha-hydroxypropionic acid and gluconic acid. The preferred organic water-soluble builder components include the salts of citric acid, in particular sodium citrate. Sodium citrate is anhydrous trisodium citrate and preferably trisodium citrate dihydrate. Trisodium citrate dihydrate is employable as finely or coarsely crystalline powder. Depending on the ultimate pH established in the washing and cleaning compositions of the present invention, in particular the dishwasher detergents, acids corresponding to the co-builder salts referred to may also be present. Particularly preferred builder components in phosphate-free formulations include methylglycine diacetate (MDGA, e.g., Trilon® M, BASF), L-glutamic acid, N,N-(biscarboxymethyl), tetrasodium salt (GLDA, Dissolvine® DL, Akzo Nobel), sodium polyaspartates (Baypure®, Lanxess) or salts of iminodisuccinic acid (Baypure®, Lanxess).

Peroxygen Compounds

Preferred peroxygen compounds are perborates and percarbonates, in particular the corresponding sodium salts thereof.

Enzymes

The enzymes optionally incorporated in the washing and cleaning compositions of the present invention, in particular the dishwasher detergents, include proteases, amylases, pullulanases, cutinases and/or lipases, for example proteases such as BLAP™, Optimase™, Opticlean™, Maxacal™, Maxapem™, Durazym™, Purafect™, OxP, Esperase™ and/or Savinase™, amylases such as Termamyl™, Amylase-LT™, Maxamyl™, Duramyl™ and/or lipases such as Lipolase™, Lipomax™, Lumafast™ and/or Lipozym™. The enzymes used may be in a state of adsorption on carrier materials and/or embedment in enveloping substances in order that they may be protected against premature deactivation. They are incorporated in the washing and cleaning compositions of the present invention, in particular the dishwasher detergents, at preferably up to 10 wt % and more preferably at from 0.05 to 5 wt %, with particular preference in the form of enzymes stabilized against oxidative degradation.

Alkali Carriers

The washing and cleaning compositions of the present invention, in particular the dishwasher detergents, preferably incorporate the usual alkali carriers such as, for example, alkali metal silicates, alkali metal carbonates and/or alkali metal bicarbonates. The alkali carriers typically used include carbonates, bicarbonates, and alkali metal silicates having an $SiO_2/M_2O$ (M=alkali metal atom) molar ratio of 1:1 to 2.5:1. The alkali metal silicates may be incorporated at up to 40 wt %, in particular at from 3 to 30 wt %, relative to the overall weight of the washing and cleaning composition. The alkali carrier system whose use in the washing and cleaning compositions of the present invention, in particular the dishwasher detergents, is preferred is a mixture of carbonate and bicarbonate, preferably sodium carbonate and sodium bicarbonate, and said mixture may be incorporated at up to 50 wt % and preferably at from 5 to 40 wt %.

In a further preferred embodiment of the invention, the washing and cleaning compositions of the invention, in particular the dishwasher detergents, incorporate from to 60 wt % of water-soluble organic builders, in particular alkali metal citrate, from 3 to 20 wt % of alkali metal carbonate and from 3 to 40 wt % of alkali metal disilicate.

Surfactants

The washing and cleaning compositions of the present invention, in particular the dishwasher detergents, may optionally also incorporate surfactants, in particular anionic surfactants, zwitterionic surfactants and preferably low-sudsing nonionic surfactants, added for better detachment of greasy stains, as wetting agents and possibly as granulation assistants in the manufacture of these compositions. Their amount may be up to 20 wt %, preferably up to 10 wt %, and more preferably is in the range from 0.5 to 5 wt %, all relative to the overall weight of the washing and cleaning composition.

Dishwasher detergents in particular typically utilize extremely low-foam compounds. These preferably include $C_{12}$-$C_{18}$ alkyl polyethylene glycol polypropylene glycol ethers each containing up to 8 mol of ethylene oxide and propylene oxide units in the molecule. However, it is also possible to use other renowned low-foam nonionic surfactants, for example $C_{12}$-$C_{18}$ alkyl polyethylene glycol polybutylene glycol ethers each containing up to 8 mol of ethylene oxide and butylene oxide units in the molecule, endcapped alkyl polyalkylene glycol mixed ethers and also the admittedly sudsing, but ecologically attractive $C_8$-$C_{14}$ alkylpolyglucosides having a degree of polymerization of about 1 to 4 and/or $C_{12}$-$C_{14}$ alkyl polyethylene glycols having 3 to 8 ethylene oxide units in the molecule. Suitable are likewise surfactants from the family of glucamides such as, for example, alkyl-N-methylglucamides in which the alkyl moiety preferably derives from a fatty alcohol having a carbon chain length of $C_6$-$C_{14}$. It is advantageous in some instances when the surfactants described are employed in the form of mixtures, for example the combination of alkylpolyglycoside with fatty alcohol ethoxylates or glucamide with alkylpolyglycosides. The presence of amine oxides, betaines and ethoxylated alkylamines is also possible.

pH Regulators

To establish a desired pH when not automatically resulting from mixing the other components, the washing and cleaning compositions of the present invention, in particular the dishwasher detergents, may incorporate system-compatible and environmentally compatible acids, in particular citric acid, acetic acid, tartaric acid, malic acid, lactic acid, glycolic acid, succinic acid, glutaric acid and/or adipic acid, but also mineral acids, in particular sulfuric acid or alkali metal hydrogensulfates, or bases, in particular ammonium hydroxide or alkali metal hydroxides. The level of pH regulators of this type in the washing and cleaning compositions of the present invention, in particular the dishwasher detergents, preferably does not exceed 10 wt % and more preferably is in the range from 0.5 to 6 wt %, relative in each case to the overall weight of the composition.

Organic Solvents

Organic solvents useful in the washing and cleaning compositions of the present invention, in particular the dishwasher detergents, in particular when these are in liquid or pasty form, include alcohols of 1 to 4 carbon atoms, in particular methanol, ethanol, isopropanol and tert-butanol, diols of 2 to 4 carbon atoms, in particular ethylene glycol and propylene glycol, and also mixtures thereof, and the ethers derivable from the recited classes of compounds. The level of water-miscible solvents in the washing and cleaning compositions of the present invention, in particular dishwasher detergents, preferably does not exceed 20 wt % and more preferably is in the range from 1 to 15 wt %.

Glass Corrosion Inhibitors

To inhibit glass corrosion during the rinse cycle, the washing and cleaning compositions of the present invention, in particular the dishwasher detergents, may incorporate glass corrosion inhibitors. Crystalline layered silicates and/or zinc salts are particularly advantageous here. Crystalline layered silicates are available for example from Clariant under the trade name of Na-SKS, e.g. Na-SKS-1 ($Na_2Si_{22}O_{45}.xH_2O$, kenyaite), Na-SKS-2 ($Na_2Si_{14}O_{29}.xH_2O$, magadiite), Na-SKS-3 ($Na_2Si_8O_{17}.xH_2O$ or Na-SKS-4 ($Na_2Si_4O_9.xH_2O$, makatite). Suitable among these are in particular Na-SKS-5 (alpha-$Na_2Si_2O_5$), Na-SKS-7 (beta-$Na_2Si_2O_5$, natrosilite), Na-SKS-9 ($NaHSi_2O_5.H_2O$), Na-SKS-10 ($NaHSi_2O_5.3H_2O$, kanemite), Na-SKS-11 (t-$Na_2Si_2O_5$) and Na-SKS-13 ($NaHSi_2O_5$), but in particular Na-SKS-6 (delta-$Na_2Si_2O_5$). An overview of crystalline sheet-silicates is found, for example, in the article published in "Seifen-Öle-Fette-Wachse, 116 volume, No. 20/1990", on pages 805-808.

In a further preferred embodiment of the invention, the washing and cleaning compositions of the present invention, in particular the dishwasher detergents, incorporate the crystalline layered silicate at preferably 0.1 to 20 wt %, more preferably 0.2 to 15 wt % and more preferably 0.4 to 10 wt %, all relative to the overall weight of the composition.

To control glass corrosion, washing and cleaning compositions of the present invention, in particular dishwasher detergents, may incorporate at least one zinc or bismuth salt, preferably selected from the group of organozinc salts, more preferably selected from the group of soluble organozinc salts, yet more preferably selected from the group of soluble zinc salts of monomeric or polymeric organic acids and yet still more preferably selected from the group consisting of zinc acetate, zinc acetylacetonate, zinc benzoate, zinc formate, zinc lactate, zinc gluconate, zinc oxalate, zinc ricinoleate, zinc abietate, zinc valerate and zinc p-toluenesulfonate. Bismuth salts such as, for example, bismuth acetates are employable as an alternative to or in combination with these zinc salts.

Preference in the context of the present invention is given here to washing and cleaning compositions, in particular dishwasher detergents, where the amount of zinc salt, relative to the overall weight of this composition, is from 0.1 to 10 wt %, preferably from 0.2 to 7 wt % and more preferably from 0.4 to 4 wt %, irrespective of which zinc salts are used, specifically irrespective that is as to whether organic or inorganic zinc salts, soluble or insoluble zinc salts or mixtures thereof are used.

Silver Corrosion Inhibitors

Silver corrosion inhibitors may be incorporated in the washing and cleaning compositions, in particular dishwasher detergents, of the invention for silver corrosion control. Preferred silver corrosion inhibitors are organic sulfides such as cystine and cysteine, di- or trihydric phenols, optionally alkyl- or aryl-substituted triazoles such as benzotriazole, isocyanuric acid, salts and/or complexes of titanium, of zirconium, of hafnium, of cobalt or of cerium wherein the metals referred to are present in one of the oxidation states II, III, IV, V or VI, depending on the metal.

Foam Regulators

When the washing and cleaning compositions of the invention, in particular the dishwasher detergents, are prone to excessive sudsing in use in the presence of anionic surfactants, for example, they may be additionally additized with up to 6 wt %, preferably about 0.5 to 4 wt %, of a foam-suppressing compound, preferably from the group of silicone oils, mixtures of silicone oil and hydrophobicized silica, paraffins, paraffin-alcohol combinations, hydrophobicized silica, bisfatty acid amides, and other further known commercially available defoamers.

Further possible ingredients for the washing and cleaning compositions of the present invention, in particular the dishwasher detergents, include, for example, the sequestrants, electrolytes, additional peroxygen activators, dyes or fragrances such as, for example, perfume oils that are familiar from the prior art relating to such compositions.

Producing the Washing and Cleaning Compositions of the Invention

The production of solid washing and cleaning compositions of the present invention, in particular the dishwasher detergents, does not present any difficulties and may in principle be carried out in a known manner, for example by spray-drying or granulation, in which case the peroxygen compound and the co-granule material of the present invention are optionally added separately at a later stage. The anhydrous granulating process of the present invention is carried out at temperatures below 100° C., in particular at temperatures between 25 and 90° C.

A particularly advantageous way to produce those washing and cleaning compositions of the present invention which take the form of aqueous solutions or of solutions containing other customary solvents, in particular such dishwasher detergents, is to simply mix the ingredients, which may be introduced into an automatic mixer in the form of a solution or without a solvent.

The washing and cleaning compositions, in particular dishwasher detergents, of the present invention preferably take the form of pulverulent, granular or tableted preparations obtainable in a known manner, for example by mixing, granulating, roll compacting and/or spray drying the thermally robust components and admixing the more sensitive components, which must be considered to include specifically enzymes, bleaching agents and the bleach catalyst.

To produce washing and cleaning compositions, in particular dishwasher detergents, of the present invention in tablet form, a preferable procedure involves mixing all the constituents with one another in a mixer and using conventional tableting presses, for example eccentric presses or rotary presses, to mold the mixture using molding pressures in the range from $200\times10^5$ Pa to $1500\times10^5$ Pa.

The tablets thus obtained in a straightforward manner, which normally have flexural strengths of above 150 N, are fracture-resistant but will nonetheless dissolve sufficiently rapidly under the intended conditions of service. A tablet thus obtained preferably combines a weight of 15 to 40 g, in particular 20 to 30 g, with a diameter of 35 to 40 mm.

Those washing and cleaning compositions of the present invention which take the form of nondusting, storage-stably free-flowing powders and/or granules having high bulk densities in the range from 800 to 1000 g/l, in particular such dishwasher detergents of the present invention, are obtainable in a process wherein, in a first subsidiary step of the process, the builder components are mixed with at least a proportion of liquid mixing components to increase the bulk density of this pre-mix and then—if desired after an intervening drying operation—the further constituents of the composition, including the co-granule of the present invention, are combined with the pre-mix thus obtained.

Dishwasher detergents of the present invention are useful not only in domestic dishwashers but also in industrial/institutional dishwashers. They are added by hand or by means of suitable dosing devices. The use concentrations in the cleaning liquor are generally about 1 to 8 g/l, preferably 2 to 5 g/l.

In a dishwasher, the actual wash cycle is advantageously followed by several intermediate rinse cycles with clear water and a final rinse cycle with a customary rinse aid. The dishes obtained after drying are spotlessly clean and hygienically impeccable when dishwasher detergents according to the present invention are used.

EXAMPLES

In the examples which follow, % ages are weight percent (wt %) unless specifically stated otherwise. As regards the reported relative humidities, the % ages have the usual meaning.

Comparative Example 1

Preparation of TAED-MnTACN Co-Granules as Per WO 2010/115581, Example 1

700 g of TAED powder and 20 g of $[Mn^{IV}_2(\mu\text{-}O)_3(Me\text{-}TACN)_2](PF_6)_2.H_2O$ and 80 g of citric acid were initially charged to a laboratory mixer, mixed therein and heated therein to the requisite starting temperature of T>40° C. Then, the binder in melt form—200 g of Genapol® T 500 (fatty alcohol polyglycol ether, commercial product from Clariant based on cetearyl alcohol with on average 50 ethylene oxide units in the molecule)—was added at a temperature of T=70-75° C. under intensive agitation. The mixture was post-granulated for some minutes, then cooled down to room temperature and sieved to remove coarse and fine fractions from 200-1600 μm.

Storage Test of Co-Granule in Base Laundry Detergent Powder

To test the chemical and physical stability of the co-granule thus obtained, its storage behavior was investigated in a typical laundry detergent powder formulation. To this end, the co-granule was incorporated in IEC-A base laundry detergent powder such that the final formulation contained 2% of co-granule. The mixture was transferred into a glass bottle and stored for several days with a closed lid under climatic conditions (T=40° C., 75% relative humidity). After just one day of storage, an amine-type odor was very conspicuous on opening the glass bottle.

Comparative Example 2

Preparation of Co-Granules Example 2

800 g of TAED powder and 20 g of $[Mn^{IV}_2(\mu\text{-}O)_3(Me\text{-}TACN)_2](PF_6)_2.H_2O$ were initially charged to a laboratory mixer and mixed therein. Then, an aqueous solution of a polyacrylate (Sokalan CP 13, commercial product from BASF) was added under intensive agitation and the mixture was granulated. The moist co-granule material was in a laboratory moving-bed dryer at about 60-80° C. and subsequently sieved to remove coarse and fine fractions from 200-1600 μm.

Even in its as-produced state, the co-granule material already had an unpleasant odor which further intensified to a significant degree following storage in a base laundry detergent.

Examples 1 to 4 (Inventive)

Preparation of Inventive Co-Granules 1 to 4

The co-granules were produced under anhydrous conditions with the binders being employed in the form of their granules. The commercially available binder granules were initially ground down to a particle size of 200 to 1000 μm.

Bleach activator TAED, bleach catalyst 1-3 and solid binder were mixed in an Eyrisch mixer in the amounts reported in table 1 and the mixture was subsequently compacted using a Bepex laboratory compactor. The resulting sheet compacts were comminuted in an Alexanderwerk sieve mill to 1.25 mm and fractionally sieved at 200 to 1040 μm using a Sweco sieve. Batch size: 5 to 7 kg.

The table shows an overview of inventive co-granules 1 to 4

| | Co-granule | | | |
|---|---|---|---|---|
| | 1 | 2 | 3 | 4 |
| Substances | | | | |
| Bleach activator | TAED | TAED | TAED | TAED |
| Bleach catalyst *) | complex 1 | complex 1 | complex 2 | complex 3 |
| Binder | Sokalan ® CP 45 G | Sokalan ® CP 5 G | Sokalan ® CP 45 G | Sokalan ® CP 5 G |
| Organic acid added | — | — | — | oxalic acid |
| Composition | | | | |
| Bleach activator % | 85 | 75 | 79 | 80 |
| Bleach catalyst % | 3 | 2 | 1 | 2 |
| Binder % | 12 | 23 | 20 | 17 |
| Organic acid % | — | — | — | 1 |

TAED tetraacetylethylenediamine

*) complex 1 $[Mn^{IV}_2(\mu\text{-}O)_3(Me\text{-}TACN)_2](PF_6)_2 \cdot H_2O$, prepared as per EP 0 458 397

*) complex 2 $[Mn^{IV}_2(\mu\text{-}O)_3(Me\text{-}TACN)_2](OAc)_2$, prepared as per WO 2006/125517

*) complex 3 $[Mn^{IV}(Me\text{-}TACN)](OCH_3)_2(PF_6)$, prepared as per EP 0 544 519

Sokalan ® CP copolymers of acrylic acid, commercial product from BASF

Storage Test of Co-Granule in Base Laundry Detergent Powder

To test the chemical and physical stability of the co-granule thus obtained, its storage behavior was investigated in a typical laundry detergent powder formulation. To this end, the co-granule was incorporated in IEC-A base laundry detergent powder such that the final formulation contained 2% of co-granule. The mixture was transferred into a glass bottle and stored for several days with a closed lid under climatic conditions (T=40° C., 75% relative humidity). After 28 days of storage, the formulations were free-flowing, undiscolored and odor-neutral.

What is claimed is:

1. A storage-stable and odor-free bleaching-agent co-granule containing, in each case relative to the overall weight of the co-granule, a) 50 to 90 wt % of one or more bleach activators;

b) 0.01 to 10 wt % of one or more metal-containing bleach catalysts having at least one ligand selected from the group consisting of di- or trimethyltriazacyclononane and derivatives thereof; and c) 5 to 40 wt % of a binder of one or more room temperature solid polymers or copolymers of acrylic acid and/or methacrylic acid or their salts or partial neutralizates with a pH in the range from 3 to 9, measured as 1 wt % solution in water characterized in that it is obtained in an anhydrous granulating process and the temperature in the anhydrous granulating process is maintained below 100° C.

2. The bleaching-agent co-granule as claimed in claim 1, characterized in that it is free from alcohol ethoxylate or derivatives of ethylene oxide or of propylene oxide.

3. The bleaching-agent co-granule as claimed in claim 1, characterized in that the binder is a homo- or copolymer based on methacrylic acid.

4. The bleaching-agent co-granule as claimed in claim 1, characterized in that relative to the overall weight of the co-granule it contains in each case a) 65 to 85 wt % of one or more bleach activators;

b) 0.05 to 6 wt % of one or more metal-containing bleach catalysts having at least one ligand selected from the group consisting of di- or trimethyltriazacyclononane and derivatives thereof; and c) 10 to 30 wt % of one or more binders which are room temperature solid polymers or copolymers of acrylic acid and/or methacrylic acid or their salts with a pH in the range from 3 to 9, measured on a 1 wt % solution in water.

5. The bleaching-agent co-granule as claimed in claim 1, characterized in that the bleach activator component a) is selected from the group consisting of polyacylated alkylenediamines, acylated triazine derivatives, acylated glycolurils, N-acylimides, acylated phenolsulfonates, acylated phenolcarboxylic acids, carboxylic anhydrides, acylated polyhydric alcohols, acylated sugar derivatives, N-acylated lactams, and mixtures thereof.

6. The bleaching-agent co-granule as claimed in claim 1, characterized in that the bleach catalyst is selected from the group consisting of manganese complexes comprising at least one ligand of formula A or B Formula A

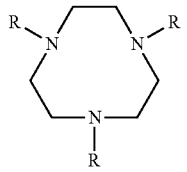

Formula B

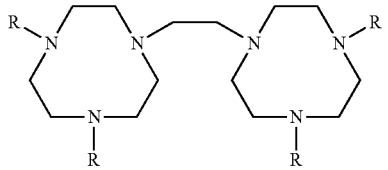

where R=H, $CH_3$, $C_2H_5$, or $C_3H_7$.

7. The bleaching-agent co-granule as claimed in claim 1, characterized in that the metal-containing bleach catalyst is selected from the group consisting of:

$[Mn^{III}_2(\mu\text{-}O)_1(\mu\text{-}OAc)_2(Me\text{-}TACN)_2](PF_6)_2$, $[Mn^{IV}_2(\mu\text{-}O)_3(Me\text{-}TACN)_2](PF_6)_2.H_2O$, $[Mn^{IV}_2(\mu\text{-}O)_2(\mu\text{-}OAc)(Me4\text{-}DTE)]Cl_2$, $[Mn^{IV}(Me\text{-}TACN)(OCH_3)_3]PF_6$ and $[Mn^{IV}(Me\text{-}TACN)(acac)OCH_3]PF_6$.

8. The bleaching-agent co-granule as claimed in claim 1, characterized in that by way of said binder component c) it contains a polymer or copolymer of methacrylic acid, in the form of its salts or in partially neutralized form, wherein a 1% solution of the binder in water has a pH in the range from 3.5 to 8.5.

9. The bleaching-agent co-granule as claimed in claim 1, characterized in that the binder is selected from (i) a copolymer of maleic acid and acrylic acid or (ii) polymethacrylic acid having an average molar mass in the range from 500 to 70 000 g/mol.

10. A method of producing bleaching-agent co-granule material as claimed in claim 1, which method comprises an anhydrous granulating process including mixing the recited components as pulverulent actives and then compacting the mixture, wherein the temperature in the anhydrous granulating process is maintained below 100° C.

11. A method of making washing and cleaning compositions comprising utilizing a bleaching-agent co-granule as claimed in claim 1 in the manufacture of the washing and cleaning compositions.

12. A washing and cleaning composition incorporating a bleaching-agent co-granule as claimed in claim 1.

13. The washing and cleaning composition as claimed in claim 12, characterized in that it incorporates the bleaching-agent co-granule in an amount ranging from 0.1 to 10 wt %, relative to the overall weight of said washing and cleaning composition.

14. The washing and cleaning composition as claimed in claim 13, characterized in that it incorporates i) 15 to 65 wt % of a water-soluble builder component, ii) 5 to 25 wt % of a peroxygen compound, iii) 0.5 to 6 wt % of a bleaching-agent co-granule as claimed in claim 1, and iv) 0 to 50 wt % of further, adjunct components selected from the group consisting of enzymes, alkali carriers, surfactants, pH regulators, organic solvents, glass corrosion inhibitors, silver corrosion inhibitors and foam regulators, all relative to the overall weight of the washing and cleaning composition.

15. The method of producing bleaching-agent co-granule material as claimed in claim 10, which method comprises mixing the recited components as pulverulent actives and then compacting the mixture, thereafter grinding the compacted mixture with or without subsequent sieving into individual particle size fractions, wherein the temperature in the anhydrous granulating process is maintained below 100° C.

16. The method of producing bleaching-agent co-granule material as claimed in claim 15, wherein the compacting is effected on roll compactors.

17. The method of making washing and cleaning compositions as claimed in claim 11 comprising utilizing the bleaching-agent co-granule as claimed in claim 1 in the manufacture of dishwasher detergents.

18. The bleaching-agent co-granule as claimed in claim 1, characterized in that the bleach activator component a) is selected from the group consisting of tetraacetylethylenediamine, 1,5-diacetyl-2,4-dioxohexahydro-1,3,5-triazine, tetraacetylglycoluril, N-nonanoylsuccinimide, N-nonanoyloxy- or n-lauroyloxybenzenesulfonate, nonanoyloxy- or decanoyloxybenzoic acid, phthalic anhydride, triacetin, ethylene glycol diacetate, 2,5-diacetoxy-2,5-dihydrofuran, acetylated sorbitol, mannitol, pentaacetylglucosc, pentaacetylfructose, tetraacetylxylose, octaacetyllactose, acetylated, optionally N-alkylated glucamine, gluconolactone, N-acylated lactams, and mixtures thereof.

19. The washing and cleaning composition as claimed in claim 12, characterized in that it incorporates the bleaching-agent co-granule in an amount ranging from 0.2 to 8 wt %, relative to the overall weight of said washing and cleaning composition.

20. The bleaching-agent co-granule as claimed in claim 1, characterized in that it has a coating in the form of a protective layer.

* * * * *